US007892065B2

(12) United States Patent
Vicentelli

(10) Patent No.: US 7,892,065 B2
(45) Date of Patent: Feb. 22, 2011

(54) CONSTRUCTIONAL MODULAR SYSTEM WITH REMOVABLE MAGNETIC FRAMEWORK

(76) Inventor: Claudio Vicentelli, Via Soldini, 14/A, Chiasso (CH) CH-6830

( * ) Notice: Subject to any disclaimer, the term of this patent is extended or adjusted under 35 U.S.C. 154(b) by 315 days.

(21) Appl. No.: 11/578,957

(22) PCT Filed: Jan. 24, 2005

(86) PCT No.: PCT/EP2005/000655

§ 371 (c)(1),
(2), (4) Date: Oct. 19, 2006

(87) PCT Pub. No.: WO2005/102489

PCT Pub. Date: Nov. 3, 2005

(65) Prior Publication Data

US 2007/0287353 A1 Dec. 13, 2007

(30) Foreign Application Priority Data

Apr. 27, 2004 (IT) ..... MI2004A0822

(51) Int. Cl.
*A63H 33/04* (2006.01)

(52) U.S. Cl. ..... 446/92; 446/85; 446/108; 446/122; 446/129; 446/137

(58) Field of Classification Search ..... 446/85, 446/92, 102, 108, 114, 115, 122, 124, 129, 446/137, 139, 268, 133, 301; 403/171; 434/277, 434/301; 428/34.1, 36.9; 273/157 R; 335/303, 335/302

See application file for complete search history.

(56) References Cited

U.S. PATENT DOCUMENTS

| | | | | |
|---|---|---|---|---|
| 1,236,234 A | | 8/1917 | Troje | |
| 2,970,388 A | * | 2/1961 | Yonkers | 434/277 |
| 3,998,004 A | * | 12/1976 | Ehrlich | 446/92 |
| 4,038,775 A | | 8/1977 | Sato | |
| 4,118,888 A | | 10/1978 | Ogawa | |
| 4,186,515 A | | 2/1980 | Ogawa | |
| 4,462,596 A | * | 7/1984 | Yamamoto | 273/239 |
| 4,647,891 A | * | 3/1987 | Hughes | 335/302 |

(Continued)

FOREIGN PATENT DOCUMENTS

DE 31 52 024 7/1983

(Continued)

OTHER PUBLICATIONS

"Magnet." Encyclopedia Britannica. 2008. Encyclopedia Britannica Online. Dec. 23, 2008 <http://www.search.eb.com/eb/article-4447>.*

*Primary Examiner*—Gene Kim
*Assistant Examiner*—Scott Young
(74) *Attorney, Agent, or Firm*—Young & Thompson

(57) ABSTRACT

The system comprises a plurality of modular blocks (10, 14) of nonmagnetic material, to be assembled to create compositions imitating, for example, a building, a doll, an animal, a vehicle or any other fancying assembly; a framework for connecting the blocks, comprises a plurality of magnetic frame members (11, 12) removably disposable into corresponding seatings (13, 17) in each modular block (10, 14), or between adjacent blocks of the composition. The modular blocks (11, 12) and the magnetic frame members of framework have shoulder surfaces (18, 19) mutually engageable in the assembled condition of the assembly.

6 Claims, 10 Drawing Sheets

U.S. PATENT DOCUMENTS

| | | | | |
|---|---|---|---|---|
| 6,626,727 | B2 * | 9/2003 | Balanchi | 446/85 |
| 6,846,216 | B1 * | 1/2005 | Balanchi | 446/85 |
| 6,893,315 | B2 * | 5/2005 | Barri | 446/92 |
| 6,969,294 | B2 * | 11/2005 | Vicentelli | 446/92 |
| 7,038,567 | B2 * | 5/2006 | Vicentelli | 335/306 |
| 7,371,147 | B2 * | 5/2008 | Tusacciu | 446/85 |
| 2004/0043164 | A1 * | 3/2004 | Vicentelli | 428/34.1 |

FOREIGN PATENT DOCUMENTS

| | | |
|---|---|---|
| DE | 39 10 304 | 10/1990 |
| EP | 1 093 834 | 4/2001 |
| WO | WO 99/60583 | 11/1999 |
| WO | WO 2004/018064 | 3/2004 |

* cited by examiner

CONSTRUCTIONAL MODULAR SYSTEM WITH REMOVABLE MAGNETIC FRAMEWORK

BACKGROUND OF THE INVENTION

This invention refers to a constructional system comprising a plurality of modular blocks defining the shape and the external appearance of a structural assembly which are maintained in an assembled condition by means of a removable magnetic framework.

The modular blocks of the constructional system may be variously shaped and variously assemblable with one another and with the magnetic frame members to create any type of composition in any field, for example in the construction of toys, display structures, furnishings or for any other use which call for freedom and a high composition degree and modularity of the constructional blocks.

The invention also relates to a kit for the construction of an assembly comprising a set of modular blocks and sets of magnetically anchorable frame members for the composition of assemblies.

STATE OF THE ART

Constructional systems comprising magnetically anchorable modular elements have variously been proposed for example in the toy industry, for creating compositions of various types and shapes, in which the individual toy components are maintained in an assembled condition by means of permanent magnets.

Magnetic toys comprising modular elements are shown, for example, in U.S. Pat. No. 1,236,234, DE-A-31 52 024 and EP-A-1 093 834.

In particular, U.S. Pat. No. 1,236,234 relates to a magnetic toy comprising a plurality of structural blocks, provided with permanent magnets fixedly embedded into the blocks to retain the same in an assembled condition.

In a substantially similar way, DE-A-31 52 024 and EP-A-1 093 834 show magnetic toys in which use is made of a plurality of constructional blocks of elementary geometrical shapes, incorporating permanent magnets which enable the blocks to be variously assembled.

U.S. Pat. Nos. 4,038,775, 4,118,888 and 4,186,515 in turn show magnetic toys comprising modular elements for the construction of dolls, human beings or animals, having a body provided with removable appendage which can be magnetically anchored to the body by means of ball joints capable to allow their articulation.

In all cases, the body of the doll or the animal incorporates a magnet and metal plates for conduction of the magnetic flux, designed to form shaped pole pieces for magnetically coupling the individual appendages of the toy.

From the foregoing it is evident therefore that, in all the cases, the various components of the system, or a part thereof, permanently incorporate one or more permanent magnets by means of which the toy components can be assembled and magnetically anchored to one another; no possibility exists to remove the magnets from the blocks and to differently or separately use the same magnets and the blocks for the construction of different assemblies or for a different use.

It is also evident that with the currently known magnetic systems, there are limited possibilities of composition and anchorage among the components, depending both on the specific characteristics of the same components, and the fixed disposition of the magnets in each individual block.

All this, in addition to limiting the constructional choice and freedom of combining the various parts of which the system is composed, also tends to limit the composing skills and imagination of a child or of a person during their use.

Moreover, the components themselves have been mainly devised and created for a specific use, without any possibility to be used for other purposes or applications differing from those as originally devised.

Modular systems for creating assemblies or reticular structures for toys, or educational purposes, are also known from DE-A-39 10 304, U.S. Pat. No. 2,970,388 and WO-A-99/60583, which make use of two types of magnetically anchorable modules; in particular, they suggest the use of a first type of frame members in the form of bar members, and a second type of frame members in the form of balls which are magnetically anchorable to the bar members to construct any type of reticular structure. In addition to the toys field, WO-A-99/60583 also suggests the use of the various magnetic modules for creating reticular structures which can be used in other technical fields, maintaining the form, structural and magnetic characteristics of the individual components wholly unchanged.

The magnetic modules of these types also have consequently been devised exclusively for their specific use, differing from that of the aforementioned magnetic toys; none of the known prior art documents suggests or make obvious any possibility of use differing from the one originally contemplated.

In all the cases, the specificity in terms of constructional possibility and use of the individual elements which make up these toys, considerably limits their possible applications and their flexibility in use, unless to resort to uneconomically and costly solutions.

OBJECTS OF THE INVENTION

The main object of this invention is to provide a constructional system, which makes use of modular blocks and a particular magnetic framework for differently assembling and removably connecting the various blocks of the system, capable of offering considerable flexibility of use and a high degree of modularity, as well as the construction of assemblies or compositions which are unlikely to be obtained with the magnetic systems currently known.

A further object of the invention is to provide a constructional system, as mentioned previously, which in addition to allowing a high modularity degree, is extremely economical, easy to use, and at the same time is suitable for any employment in different technical fields.

A further object of the invention is to provide a constructional system, having a magnetic framework, according to which it is possible to create complex structures or compositions, of any size and/or for any use, which are highly stable and characterised by high structural resistance; this is highly desirable in the case of complex compositions, intended for uses other than from toys, for example for furnishing or display structures or for other uses which call for quick and easy assembling of the various components, without the need to make use of tools and/or particular instruments.

A still further object of this invention is to provide a constructional system, as mentioned previously, which makes use of certain magnetic components as an integrant part of the same system, both for the connection between the blocks, and for an independent use.

A particular object of this invention is to provide a modular system for toys, furnishing items and the like, whereby it is possible to create specific planar and/or three-dimensional constructions or building structures, human beings, animals, or purely imaginary structures, maintaining a wide freedom of choice and composition of the various elements of the system, and their different use in relation to the shape, size and characteristics of each individual composition to be created.

BRIEF DESCRIPTION OF THE INVENTION

These and other objects of this invention are achieved by means of a constructional block system according to claim 1 and a kit according to claim 27.

The invention is based on the principle of making use of modular blocks of non-magnetic material, variously shaped and capable of being differently assembled to simulate any type of structure or composition, in combination with a plurality of magnetically anchorable frame members removably disposed or housed into corresponding holes and/or seats in the same modular blocks, thereby creating a connection between the blocks and a support magnetic framework adaptable each time to the shapes, dimensions and characteristics of the compositions during the construction of an assembly.

According to a first aspect of the invention, a constructional modular system has been provided for the construction of toys, furnishing, display structures and similar assemblies, including:

a plurality of shaped block members to compose an assembly, said block members having peripheral contact surfaces;

a plurality of magnetically anchorable frame members for assembling the shaped block members of the assembly;

characterised in that said frame members comprise:

first elongated frame members removably disposable into an elongated through hole of at least one block member of the assembly, extending between shoulder surfaces;

second shaped frame members conformed to rest against said shoulder surfaces;

said first and second frame members being magnetically engageable each other and arranged to provide a removable magnetic framework retaining the block members in an assembled condition of the assembly.

According to a further aspect of the invention, a constructional system of blocks, has been provided, wherein the magnetic framework comprises a first set of magnetically anchorable bar-shaped members, and a second set of magnetically anchorable frame members, each provided with a peripheral surface for resting against shoulder surfaces of modular blocks, respectively for magnetic connection with the bar-shaped members in an assembled condition of the modular blocks.

According to the invention, the blocks of the system can be in the form of modular elements of different dimensions, and/or variously shaped to imitate structural and/or functional parts of any dimensional structure, for example to imitate a toy construction of any civil or industrial buildings or other types of composition.

Preferably, the aforesaid first and second sets of frame members consist of differently shaped body members, variously combinable and magnetically anchorable with one another, and/or to the bar shaped members inside the covering blocks; however, it is not excluded that for certain applications, in combination and/or in replacement of said first and second frame members, it is possible to make use of elongated frame members having a widened head at one end, simultaneously providing both an anchoring surface for magnetic connection with another magnetic frame member, and a shoulder surface for resting against a corresponding shoulder surface of a modular block.

According to another feature of the invention, the covering blocks can be adapted and/or used to create toys of various shapes and kinds: for example vehicles, puppets, dolls, animals, robots or purely imaginary living creatures, provided with removable appendages and suitable articulations, which from time to time can be quickly and easily assembled and disassembled, while maintaining the possibility of differently using the magnetic frame members in a wholly conventional manner, for the construction of reticular structures, in a way similar to that suggested in several of the aforementioned prior documents.

BRIEF DESCRIPTION OF THE DRAWINGS

These and further features and scopes of this invention, will be more clearly evident from the following description, with reference to the accompanying drawings which show in a non-restrictive way, a number of examples illustrating both differently shaped modular blocks, and frame members, as well as several possible compositions, or parts thereof. In particular.

DETAILED DESCRIPTION OF THE INVENTION

Figure 1:
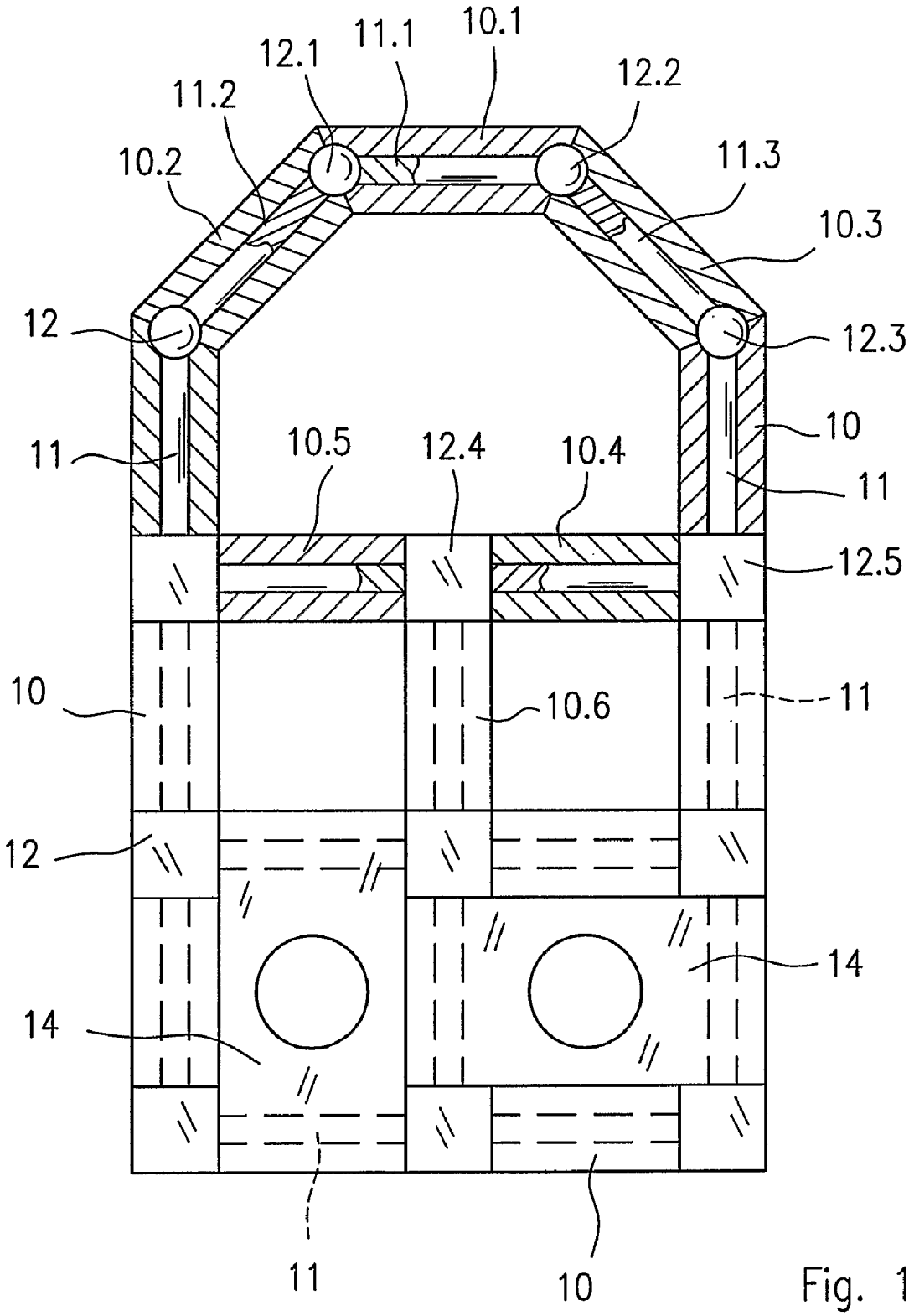
FIG. 1 shows a front view of a generic composition obtained with several modular blocks, and with several frame members according to the invention.

With reference to FIG. 1, a description will be given hereunder of a first embodiment of a generic-building structure comprising modular blocks and a magnetic framework according to this invention, as well as some of the numerous possible embodiments of the modular blocks and the magnetic frame members of the framework.

What is described hereunder with reference to the accompanying drawings is given purely in order to illustrate the general feature of the invention, its numerous applications and several preferential embodiments of the variously shaped block members and frame members of the system; it is pointed out however that other embodiments both of the modular blocks, and of the magnetic frame members, are possible within the scope of this invention, depending upon the types and the specific compositions that are to be created.

It is also pointed that for this specification, the term "magnetic frame member" is understood to indicate both any magnetically active anchoring element consisting of, or comprising at least one permanent magnet, and any ferromagnetic element, magnetisable by induction, capable of allowing a magnetic connection between adjacent frame members and the construction of a framework for supporting and locking any type of modular blocks, regardless of their shapes and dimensions. For example, the magnetic frame members can be of the type described and illustrated in DE-A-39 10 304, WO-A-99/60583 or WO-A-03/003388, the contents of which are understood to be incorporated in this description.

FIG. 1 shows a generic construction of a building toy by assembling differently shaped modular blocks and magnetic frame members of the system according to this invention.

As shown, the construction comprises a plurality of modular blocks, indicated by reference numbers 10, 14, capable of providing structural and aesthetical parts of a composition, for example imitating columns, beams, walls and/or arch-shaped parts.

The construction of FIG. 1 also comprises a plurality of a first type of magnetic frame members, generically indicated by the reference number 11, and a plurality of a second type of magnetic frame members generically indicated by reference number 12; both the magnetic frame members 11 and the magnetic frame members 12 provide a magnetic framework in which all parts of the frame members are removably housed into respective seatings in the blocks 10, or are disposed between adjacent modular blocks in such a way as to define various connection points between the blocks 10 and 14 of the entire composition.

As explained further on, the modular blocks 10 can be of any shape and dimensions, or can be combined with blocks of another type, as indicated by reference 14 in the same FIG. 1, where the blocks 14 are rectangular in shape and used as closing elements for some walls of the construction.

The various modular blocks 10, 14 of FIG. 1 mainly perform an aesthetical function, in that the connection between blocks is performed by a framework consisting of removable magnetic frame members 11 and 12, as explained further on.

According to this invention, the modular blocks 10 are composed of any type of non-magnetisable material, such as wood, cardboard, plastic material, metal, glass or other suitable combination of non-magnetisable material.

The shape and cross section of the modular blocks 10 can be any. For example the shape can be rectilinear, curved, square, circular, polygonal or other possible shapes; likewise, the cross section of the blocks 10 can in turn be triangular, square, rectangular, polygonal, cylindrical or of any other suitable shape or their combination. The individual blocks 10 can also comprise appropriate shoulder surfaces, and one or more seats for housing or resting against magnetic frame members, as explained further on.

The magnetic frame members 11 and 12, can be shaped and sized in any way, in relation to the intended use.

In particular, in the example of FIG. 1 use has been made of square section blocks 10, whose end surfaces lie in orthogonal planes, or forming an angle with respect to the longitudinal axis or the side walls of the block; use has also been made of cylindrical frame members 11, as well as of ball-shaped and cube-shaped magnetic frame members 12, as shown.

Both the modular blocks 10, 14, and the magnetic frame members 11 and 12 may be of identical or different dimensions, so as to allow a high freedom degree of composition; or can have various modular shapes and dimensions suitable for creating specific structures or compositions.

Figure 2:
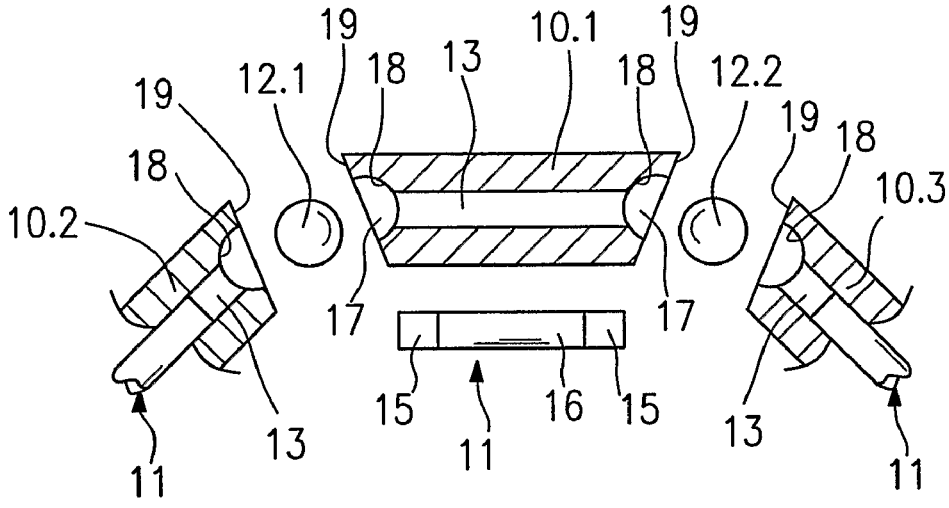
FIG. 2 shows an exploded view of the upper part of FIG. 1.

As shown in FIG. 2, which represents an exploded view of the upper part of FIG. 1, each modular block 10 can comprise one or more seats conformed and arranged for removably housing the magnetic frame members, or can comprise shoulder surfaces for the magnetic frame members 11 and/or 12 for the connection of the blocks 10, 14, as shown in the various examples.

More precisely, with reference to the exploded view of FIG. 2, in which the three upper blocks of FIG. 1 have been indicated with references 10.1, 10.2 and 10.3, each block has a longitudinal hole 13 open at both ends, which defines a seat for housing a first magnetic frame member 11, in the form of an elongated bar comprising, in this case, two axially polarised permanent magnets 15, disposed at both ends of an intermediate core member 16 of ferromagnetic material, to conduct the magnetic flux between the poles of the magnets 15, having opposite polarities.

The central block 10.1, likewise to the lateral blocks 10.2 and 10.3, is provided at each end with a semi-spherical seat 17 designed to partially house the ball-shaped members 12.1 and 12.2 of the framework.

Each seat 17 for housing the ball members 12.1, 12.2 is in turn provided with a shoulder surface 18 for resting the ball member 12, which in this specific case extends as far as the contact surface 19 at the ends of the blocks 10.1, 10.2 and 10.3.

Moreover, the radius of curvature of the shoulder surface 18 corresponds, or can be wider than the radius of curvature of the ball members 12.1 and 12.2, which can thus be freely disposed and removed from the seats.

The hole 13 forming the seat for the elongated bar-shaped member 11, in turn has a diameter or cross dimensions slightly larger than those of the magnetic bar members 11. In this way, according to the invention, both the bar shaped frame members 11 and the ball-shaped frame members 12 can be partially or totally and freely disposed into and removed from the respective seatings in the blocks 10.

At the time of composition, each magnetic frame member 11 can therefore be easily inserted into a corresponding seat 13 of a block 10, or threaded along axially aligned seats 13 in adjacent blocks; the magnetic frame members 12 can in turn be inserted into respective seats 17. In this way the frame members 12 at both ends of blocks 10 are magnetically anchored to the frame member 11, resting against the shoulder surfaces 18 to obtain, upon completion of the construction, the formation of an assembly comprising a connecting framework in which the magnetic frame members and modular blocks can be easily disassembled and reused for a same or different compositions or for another use.

In the case of FIGS. 1 and 2, each contacting surface 19 between the blocks 10 lies in a plane forming a pre-established angle with the longitudinal axis of the block itself, to come into contact with a similarly slanted surface 19 at the opposite end of an adjacent block, thereby preventing the detachment and relative sliding movement between blocks 10 by the ball members 12, while maintaining the possibility of rotating one block with respect to the other one on the contacting surfaces 19, according to their longitudinal axis; in this way they are held firmly together. It should also be noted that in the case of FIG. 2, the axis of the hole 13 which extends longitudinally to the block 10 between the shoulder surfaces 18, forms a given angle with the axis of the semi-spherical seat 17, coinciding with the straight line passing through the geometrical centre of the same seat, which is orthogonal to the plane of the contact surface 19; however, as shown in several of the subsequent figures, the two axes could be aligned with each other, or coincide, or be disposed at 90° so that the ball member 12 or equivalent magnetic frame member can be disposed on, and removed from one side of the block 10.

Figure 3:
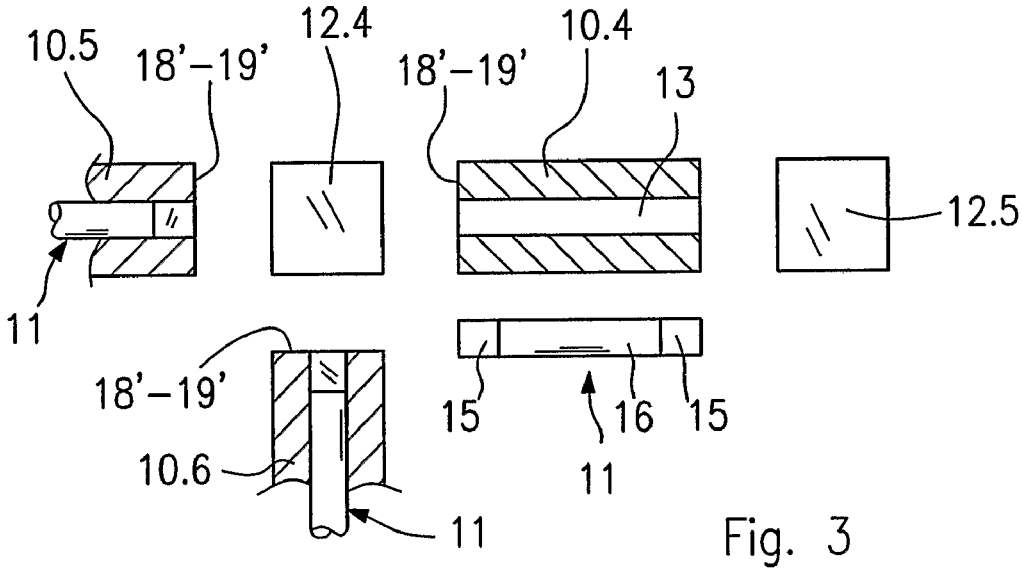
FIG. 3 shows an exploded view of an intermediate part of FIG. 1.

FIG. 3 of the drawings shows a condition substantially similar to that of the preceding FIG. 2, for the central part of the composition of FIG. 1.

FIG. 3 differs from FIG. 2 in that the magnetic frame member 12.4, being cubic in shape, is delimited by flat shoulder surfaces designed to come into contact with corresponding flat shoulder surfaces 18' at the ends of the blocks 10.4, 10.5 and 10.6, lying in planes orthogonal to the longitudinal axis of the blocks themselves. Also in the case of FIG. 3, the magnetic frame members 11 can be freely inserted into respective seats 13 of the blocks 10.4, 10.5 and 10.6, while the frame member 12.4 can be freely positioned between the aforesaid blocks.

Lastly, it should be noted that in the case of FIG. 3, the shoulder surfaces 18' for the magnetic frame members 12.4 and 12.5, come to coincide with the contact surfaces 19' at the ends of the modular blocks.

Figure 4:
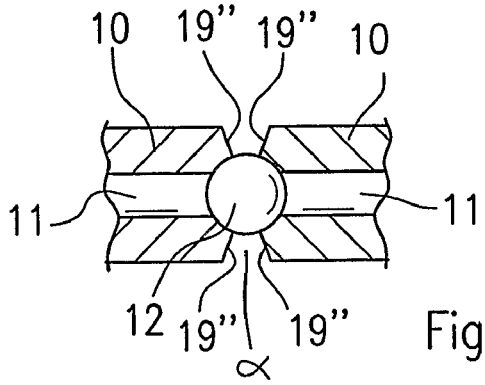
FIG. 4 shows an articulated joint.

As an alternative to the solutions of FIGS. 2 and 3, it is possible to contemplate on one or on two opposite sides of each block 10, the formation of contact surfaces having angles of inclination differing from one another and with respect to the longitudinal axis of the blocks, as indicated by references 19" in FIG. 4; in this way, an angle $\alpha$ is formed between opposite contact surfaces, which makes it possible to achieve an articulating or pivotal movement between adjacent blocks.

Figure 5:
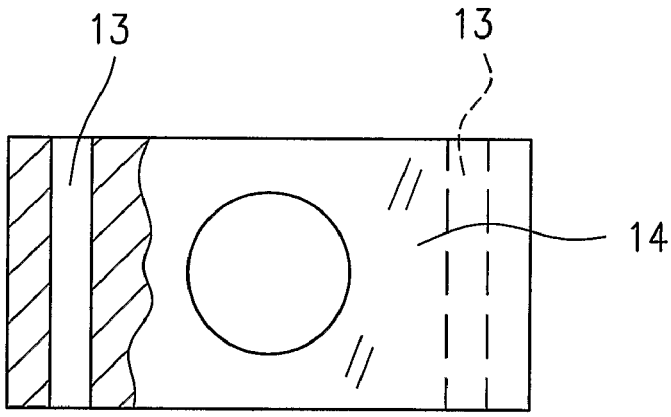
FIG. 5 shows a first covering block.

FIG. 5 shows another possible embodiment of a modular block; in particular, it shows one of the two blocks 14 of FIG. 1, substantially consisting of a square or rectangular-shaped element designed to form a lateral closure wall, wherever required, with apertures designed to simulate doors, windows or other aesthetical features of a building, or of any other type of construction or purpose; in the case of FIG. 5, the block 14 is provided with two side holes 13 for introduction of the magnetic bar members 11, which extend between two side surfaces of the same block.

Figure 6:
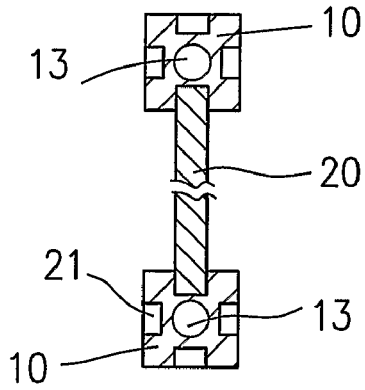
FIG. 6 shows an alternative solution to the block of FIG. 5.

As an alternative to the block 14 of FIG. 5, as shown in FIG. 6, it is possible to contemplate the use of a panel 20 which can be inserted into longitudinal slots 21, provided on one or more sides of the modular blocks 10, or of other blocks of the toy, spaced apart from and parallel with one another.

Figure 7:
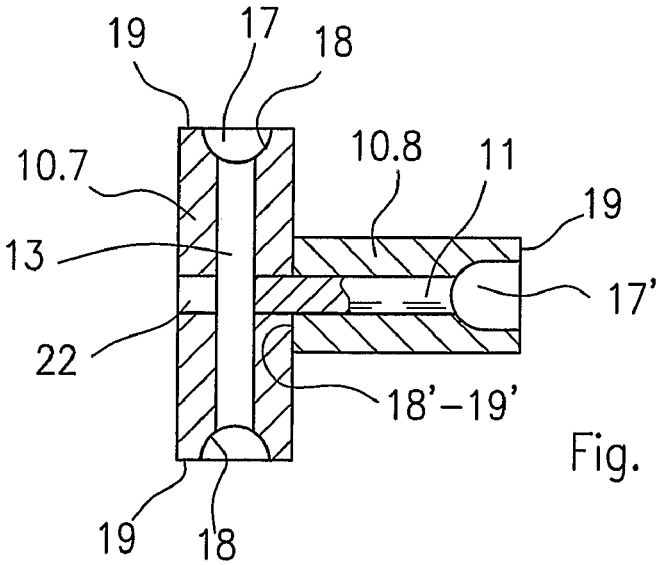
FIG. 7 shows two different covering blocks, in an assembled condition.

FIG. 7 shows two possible embodiments of the blocks 10 with respect to those previously described; in FIG. 7 the same reference numbers as in the previous figures have been used to indicate similar or equivalent parts.

In particular, FIG. 7 shows two modular blocks 10.7 and 10.8 having different lengths and differently shaped seats for housing the ball-shaped magnetic frame members 12.

More precisely, the block 10.7 is provided with a longitudinal hole 13 for the insertion of an elongated magnetic bar member 11, which opens out at both ends towards corresponding seats 17, for example semi-spherical or semi-cylindrical in shape, or suitably shaped for partially containing a magnetic frame member 12 for anchoring and interconnecting the blocks 10.

In the same FIG. 7, reference 22 has been used to indicate cross holes in respect to the longitudinal hole 13 of the block 10.7, into which one end of a bar shaped magnetic frame member 11, which partially protrudes from a lateral block can be threaded, for example the end of the block 10.8 to locally create a magnetic and mechanical connection capable of strengthening the connection between blocks, thereby preventing any relative sliding movement, and enabling their rotation on the contact plane.

In the case of the block 10.8 of FIG. 7, a possible variation is also shown with regard to the housing for the magnetic frame members and for interconnection between adjacent blocks.

In fact, the block 10.8 is provided at one end with a seat 17' shaped in such a way as to totally contain a magnetic frame member 12, whenever it is considered necessary. The depth of the seat 17' can be equivalent to the diameter, thickness, length or corresponding dimension of the frame member 12, or greater, so that the latter is disposed tangentially to the plane of the end surface 19 of the block, or totally inside it; whenever the seat 17' is destined to house a ball-shaped or a cylindrical-shaped frame member, and whenever the depth of said seat is equivalent to the diameter or dimension of the frame member, in this way the magnetic anchorage between frame members 11 and 12 of adjacent blocks is made possible, unless the frame member 11 of the adjacent block is made to protrude.

Figure 8:
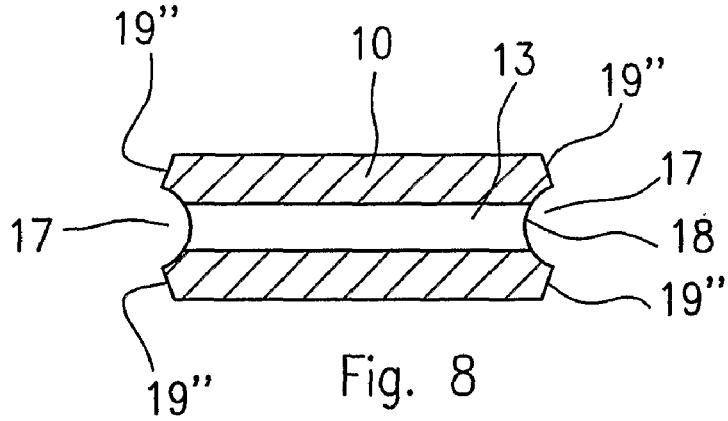
FIG. 8 shows a further block.

FIG. 8 shows a further possible embodiment of the block 10; here too, the same reference numbers have been used to indicate parts similar or equivalent to those of the preceding figures.

Block 10 of FIG. 8 differs in that it is provided, at each end, with a seat 17 for partially housing, for example a ball-shaped or cylindrical-shaped frame member, at both ends of the longitudinal hole 13.

Again in FIG. 8 reference 18 has been used to indicate the shoulder surface for the frame members 12, while references 19' and 19" have again been used to indicate two slanted contact surfaces between adjacent blocks, or capable of allowing an articulated or pivotal movement.

FIGS. 9, 10, 11, 12 and 13 show, by way of example, several of the numerous embodiments of the magnetic frame members 11 and 12 forming part of the magnetic framework in a constructional system according to the invention.

Figure 9:
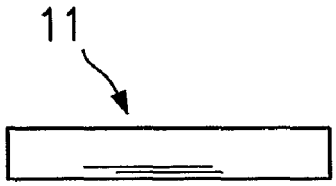
FIG. 9 shows a first bar-shaped frame member.

FIG. 9 schematically shows an elongated bar-shaped magnetic frame member 11, obtainable in any way; for example the frame member 11 can consist of a simple cylindrical or polygonal-shaped bar made of ferromagnetic material.

As an alternative, the bar 11 can consist of a single permanent magnet, or comprise at least one permanent magnet and a ferromagnetic element, magnetisable by induction, in direct contact with the magnet so as to provide, at one of its ends, a magnetic anchoring surface having a polarity corresponding to that of the magnet itself, thereby constituting a sort of polar extension.

According to a further embodiment, shown previously in FIG. 2, the elongated element 11 can comprise a permanent magnet 15 at both ends between which an intermediate spacer 16 extends, for example tubular in shape, onto which the two magnets 15 have been fastened; the spacer 16 again can consist of a ferromagnetic element, plastic material or any other type of material. Lastly, it should be noted that the frame members 11 of the first type can have extreme flat, concave, convex surfaces or differently shaped surfaces in any way so as to adapt to the contact surface of a frame member 12 of the second type.

Figure 10:
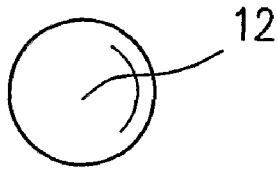
FIG. 10 shows a second ball-shaped frame member.
Figure 11:
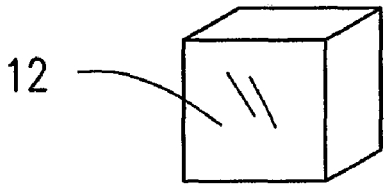
FIG. 11 shows a third magnetic frame member, in the form of a cube.

FIG. 10 shows a magnetic frame member 12 having a spherical shape, while FIG. 11 shows a cube-shaped frame member 12, of the type shown in the construction of FIG. 1.

Figure 12:
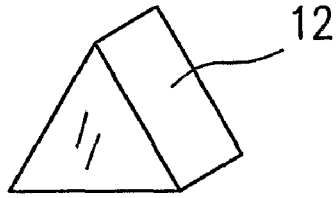
FIG. 12 shows a fourth magnetic frame member, in the form of a triangular prism.
Figure 13:
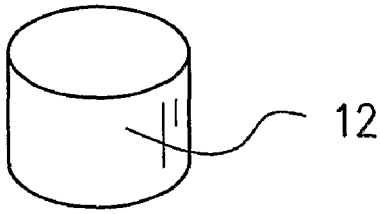
FIG. 13 shows a fifth, magnetic frame member, in the form of a cylinder.

FIGS. 12 and 13 respectively show a prismatic-shaped and a cylindrical-shaped magnetic frame member 12, which can be separately used, or in combination, with the frame members of the previous figures.

Also in the case of FIGS. 10, 11, 12 and 13, the frame members 12 can consist of ferromagnetic material, or of a permanent magnet, or comprise at least one permanent magnet in a way wholly similar to the elongated bar-shaped member 11 of FIG. 9.

FIGS. 14, 15, 16 and 17 show several examples of some junction points of a generic composition, which make use of variously shaped magnetic frame members 12, according to the examples of the preceding figures; also in these figures the same reference numbers as in the preceding figures, have been used to indicate similar or equivalent parts.

Figure 14:
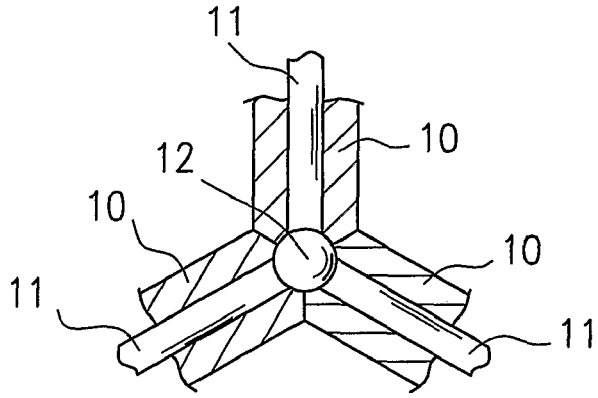
FIG. 14 shows a triangular joint obtained by means of the ball member of FIG. 10.

In particular, FIG. 14 shows a junction point between three blocks 10, in which use is made of a ball-shaped frame member 12 according to FIG. 10, the peripheral surface of which can be theoretically considered as consisting of a plurality of partial shoulder surfaces, conforming to the shoulder surfaces of the modular blocks 10.

Figure 15:
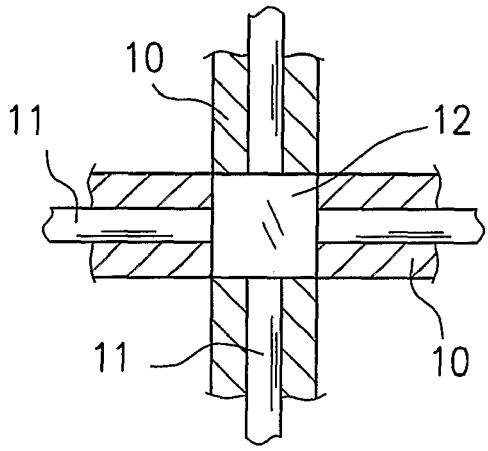
FIG. 15 shows a quadrangular joint obtained by the cube-shaped member of FIG. 11.

FIG. 15 shows a junction point between four blocks 10, in which use is made of a cube-shaped frame member 12 according to FIG. 11.

Figure 16:
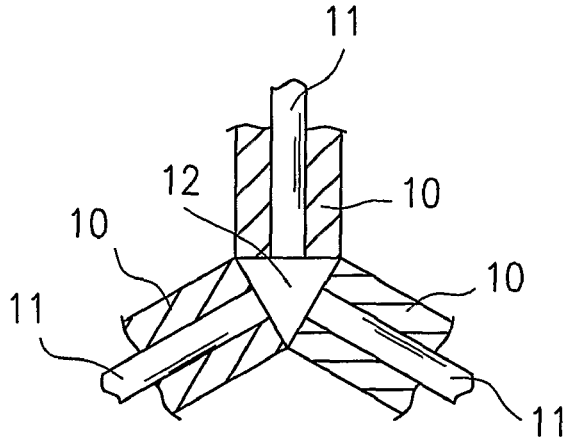
FIG. 16 shows a triangular joint obtained by means of the prismatic member of FIG. 12.

FIG. 16 shows a junction point for three blocks 10, in which use has been made of a prismatic-shaped magnetic frame member 12, similar to that of FIG. 12.

Figure 17:
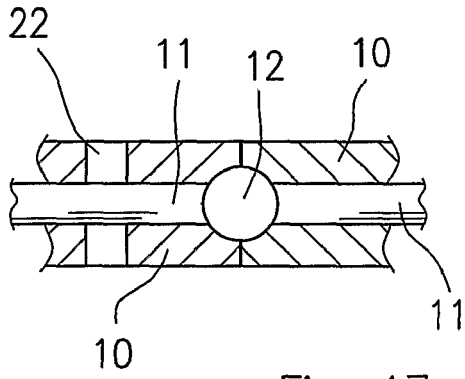
FIG. 17 shows a linear joint obtained by means of the ball member of FIG. 10.

Lastly, FIG. 17 shows a joint between two blocks 10, united by means of a ball or cylindrical-shaped member 12.

The previous figures illustrate some of the numerous and possible embodiments both of the magnetic frame members 11, 12, and of the modular blocks 10, as well as the disposition of the blocks 10 in correspondence with some junction points, which in no way must be considered as a limitation to all the possible modifications or variations which fall within the scopes of this invention; for example, as an alternative to or in replacement of the flat junction points of the previous figures, it is possible to create three-dimensional junction points.

Other embodiments of the blocks 10 are shown, also by way of example, in the following figures in which the same reference numbers as the previous figures have again been used to indicate similar or equivalent parts.

Figure 18:
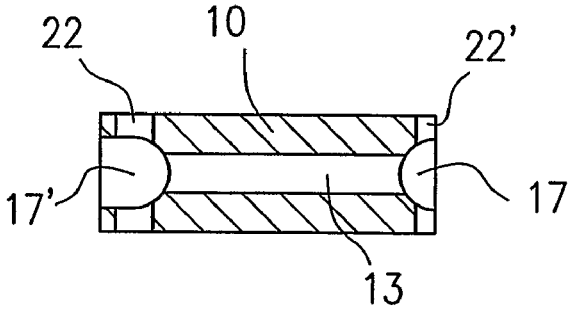
FIG. 18 shows a variation of the covering blocks.

FIG. 18 shows an elongated modular block 10, having for example a square, polygonal or circular cross section, provided with a longitudinal open-end hole 13, a first seat 17 for partially housing a magnetic ball member 12, and a second seat 17' for totally housing a magnetic ball member 12 for anchorage between blocks 10. Reference 22' indicates a half crosswise hole, at one end of the block 10, designed to combine with a similar half hole 22' of an adjacent block 10 to enable the insertion of one end of a bar member 11.

Figure 19:
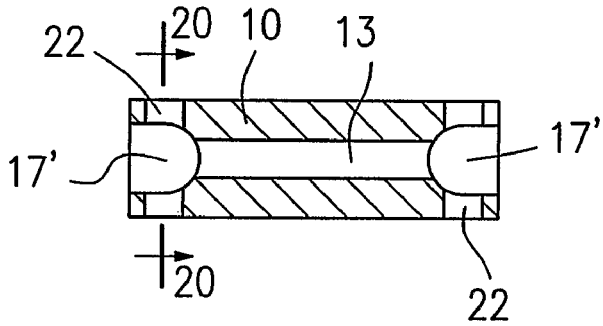
FIG. 19 shows a still further variation of the covering blocks.
Figure 20:
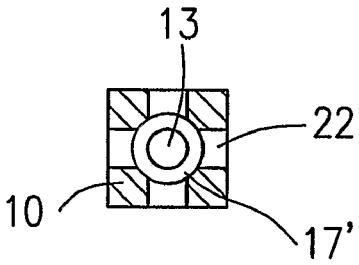
FIG. 20 shows a cutaway view along the line 20-20 of FIG. 19.

FIGS. 19 and 20 show a block 10 provided with a longitudinal open-end hole 13 and with two seats 17' for totally housing the frame members 12, as well as cross holes 22; in this case, as in the case of the previous figure, the seats 17, 17' and the hole 13 are disposed coaxially with each other.

Figure 21:
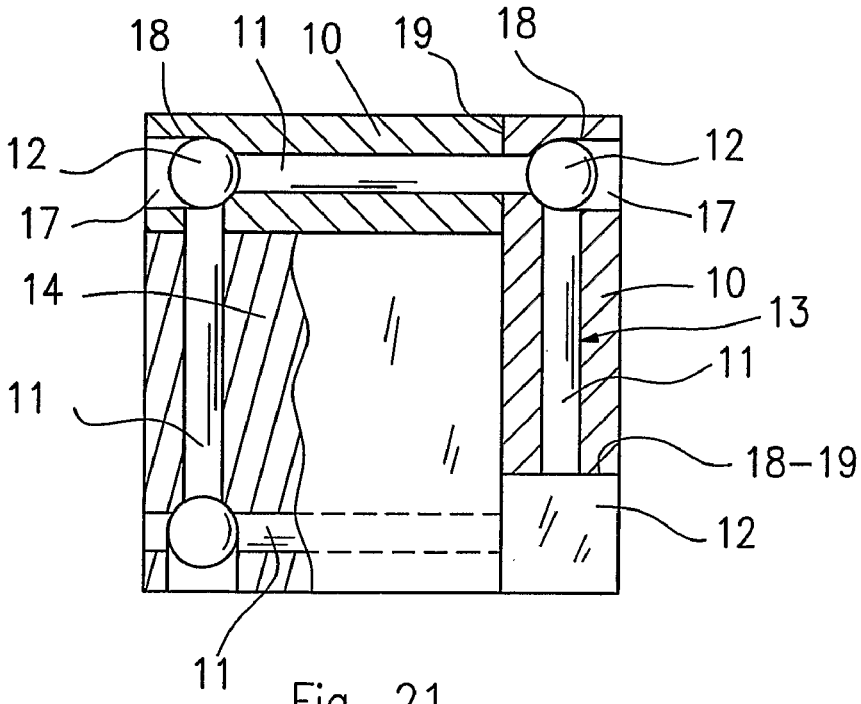
FIG. 21 shows an elementary composition and a possible magnetic framework and covering block disposition.

FIG. 21 shows an example of a possible assembly of the various blocks 10 and 14, by means of removable magnetic frame member 11 and 12 according to the invention.

In particular the example of FIG. 21 clearly shows that the adjacent blocks 10 and/or 14 are maintained one against the other by the action of an elongated bar member 11, magnetically connected to the ball members 12 resting against respective shoulder surfaces 18 of the blocks 10 and/or 14.

Figure 22:
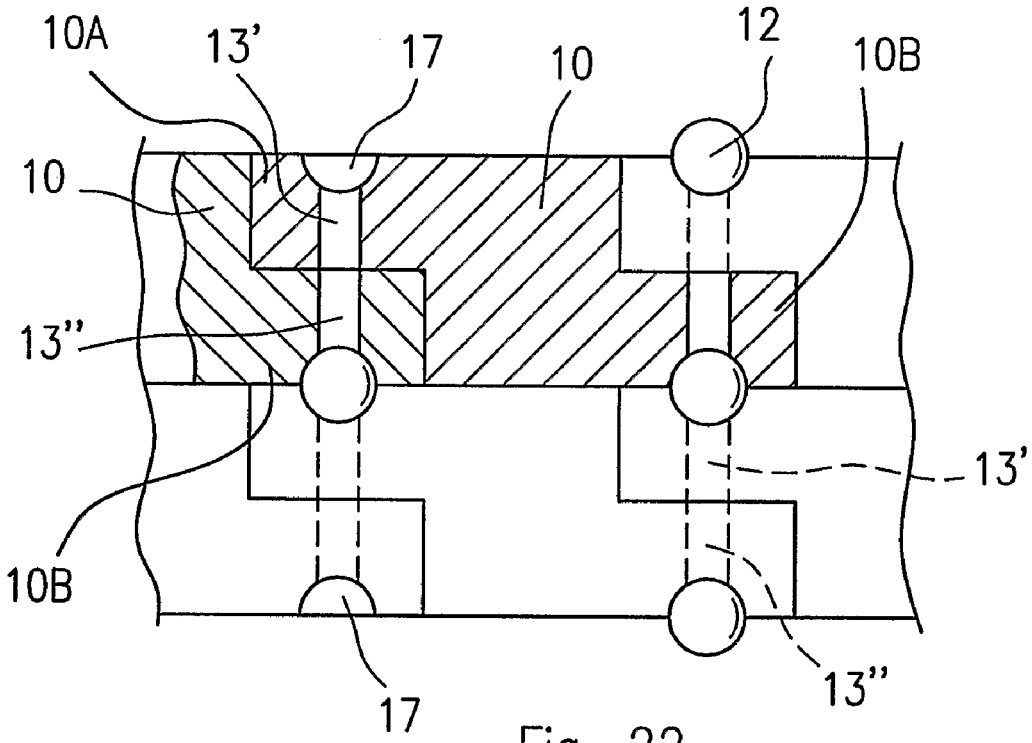
FIG. 22 shows a further possible embodiment of the covering blocks and the magnetic framework.
Figure 23:
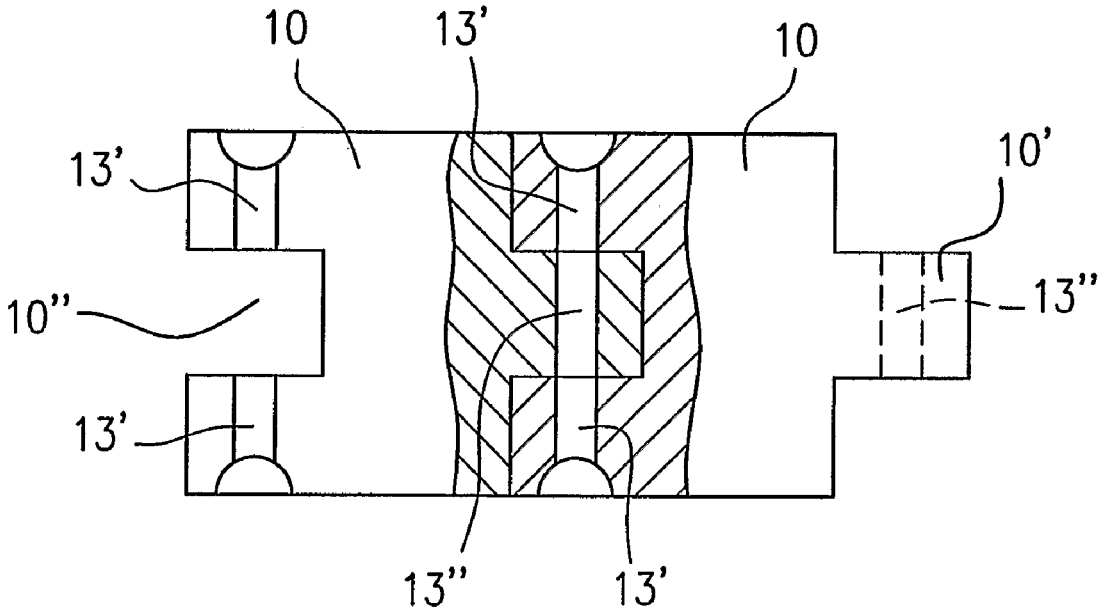
FIG. 23 shows a further variation of the blocks.

FIGS. 22 and 23 show other possible shapes of the modular blocks 10, which can be provided with protruding and/or recessed parts 10A, 10B, or 10', 10" that can be coupled by simply overlapping them or fitted them together.

It should be noted that in both the FIGS. 22 and 23, the seats 13', 13" and 13'" for the elongated bar-shaped elements 11, are composed of axially aligned holes in adjacent blocks 10, in their assembled condition.

The figures from 24 to 27 show still further embodiments, relating to the shape and disposition of the modular blocks 10 and of the magnetic frame members 11 and 12; the same reference numbers as the previous figures have been used also in these figures to indicate similar or equivalent parts.

Figure 24:
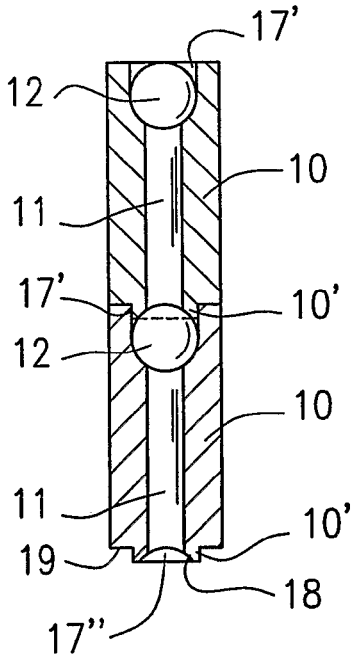
FIG. 24 shows a further variation of the blocks.

FIG. 24 shows two linear-shaped blocks, with the relevant seats for housing the magnetic frame members 11 and 12. The blocks 10 of FIG. 24 differ from the previous ones due to the presence on one end, of a partially spherical or partially cylindrical seat 17"; the blocks 10 of FIG. 24 also differ due to the fact that they are provided, on one end, coaxially to the seat 17", with a protruding edge 10' designed to be inserted into the seat 17' provided on the opposite end of an adjacent block 10.

Figure 25:
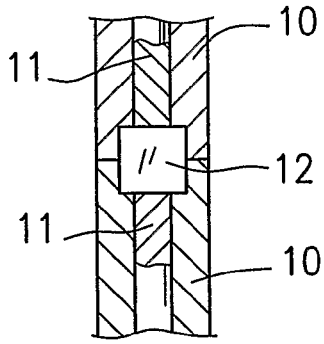
FIG. 25 shows a still further variation of the blocks.

Unlike the case of FIG. 3, FIG. 25 shows the use of a cube-shaped, or alternatively a cylindrical-shaped frame member 12, having smaller dimensions than the cross dimensions of the blocks 10 to be totally housed in corresponding seats at the opposite ends of two adjacent blocks 10. The solutions of FIGS. 23, 24 and 25, in addition to enabling the magnetic anchorage of the blocks, pre-prevent any transversal movement and lateral bending between blocks 10.

Figure 26:
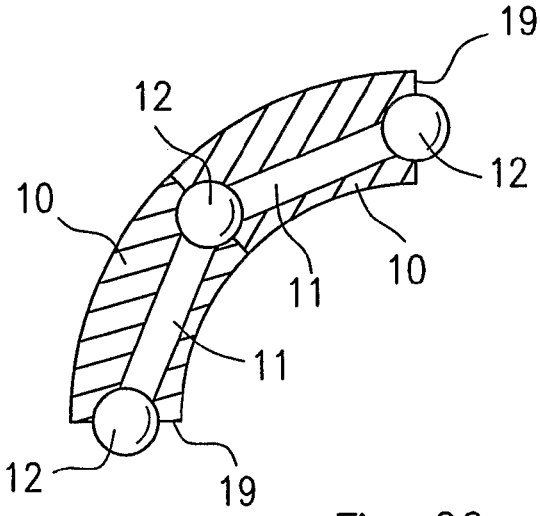
FIG. 26 shows a further embodiment of the covering blocks.

FIG. 26, unlike the previous cases, shows arched-shaped modular blocks 10, as an alternative solution to linear-shaped blocks of FIG. 24, in which the holes for the frame members 11 are differently arranged.

Figure 27:
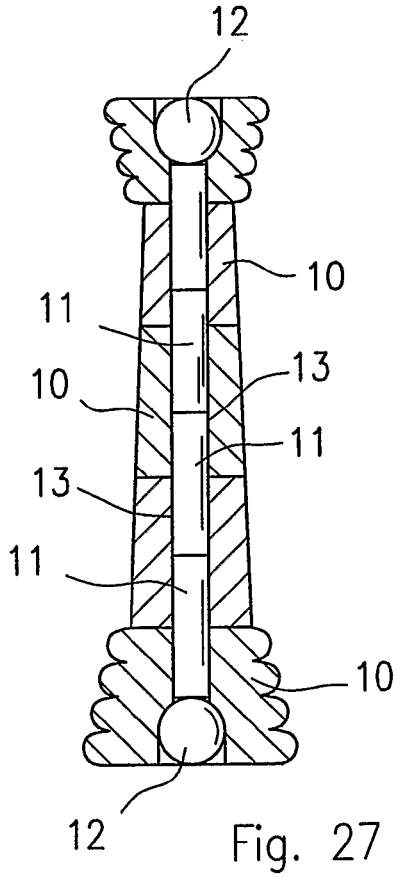
FIG. 27 shows composition and further embodiments of the covering blocks, and a different disposition of the magnetic frame members.

Lastly, FIG. 27 shows, by way of example, the construction of a column in which the elongated bar-shaped frame members 11 are of different lengths, and in which each magnetic frame member 11 extends partially into the hole 13 of one block 10, and partially into the hole 13 of an adjacent block 10. Also in this case, the disposition of the elongated magnetic frame members 11 is such as to prevent any lateral movement and/or bending of the various blocks 10.

Figure 28:
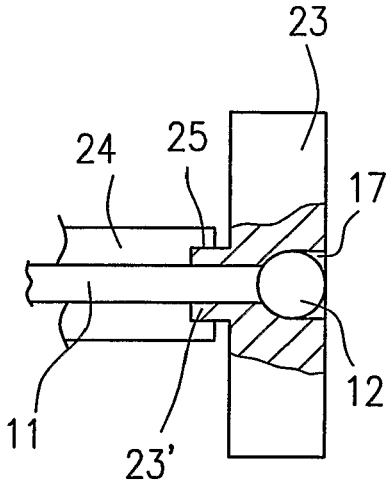
FIG. 28 shows the assembly of a rotating element.

FIG. 28 shows another possible application of this invention. In particular, FIG. 28 indicates a movable block 23 designed to be connected, with the possibility of rotating, to a block 24 partially shown; for example the block 23 can constitute a wheel of a generic vehicle, or other movable part having a hub 23' inserted into an appropriate seat 25 at the end of a block 24; the wheel 23 is maintained in an assembled condition on the block 24, with the possibility of rotating, by means of the magnetic frame members 11 and 12 of the previously described types.

Figure 29:
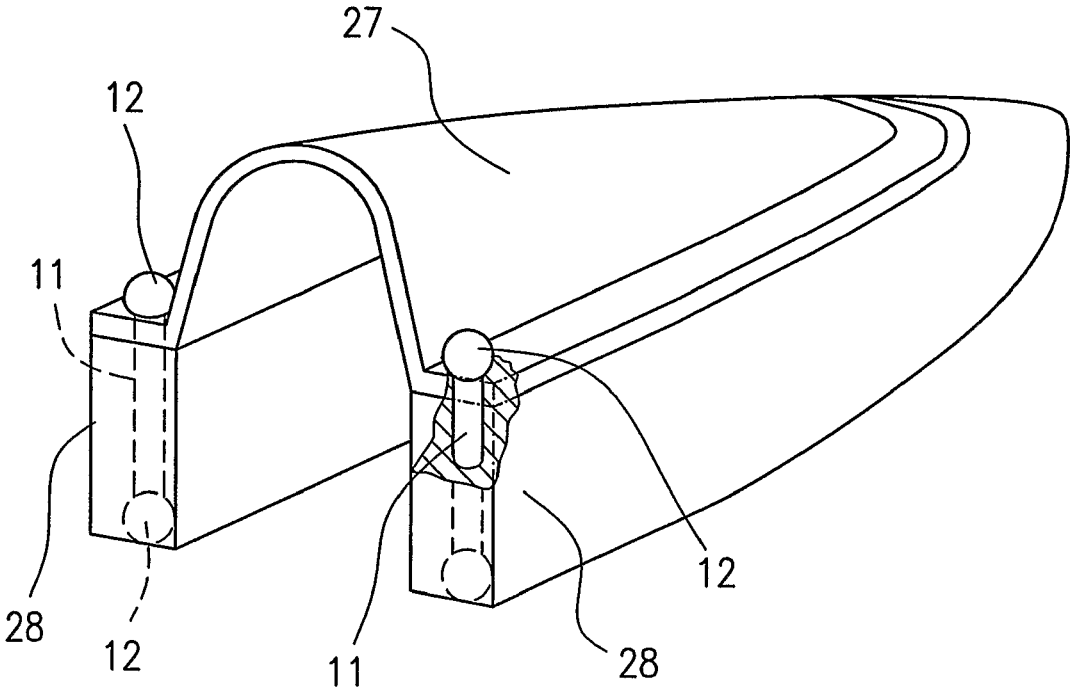
FIG. 29 shows the detail of a canopy of a generic vehicle.

FIG. 29 shows a fancy construction, for example in the form of a canopy 27 for a generic vehicle; the canopy 27 is secured to lateral blocks 28 by means of the magnetic frame members 11 and 12, as previously described.

In the cases described up till now, the assembling and the anchoring between the various modular blocks 10 is achieved by using elongated bar-shaped members 11 of a first type, in combination with magnetic frame members 12 of a second type, differently shaped and provided with shoulder surfaces, capable of forming the jointing between the blocks.

Figure 30:
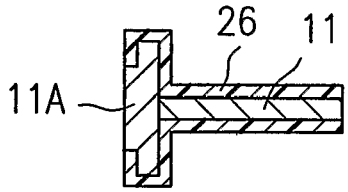
FIG. 30 shows a variation of one of the magnetic frame members.
Figure 31:
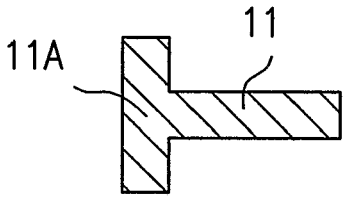
FIG. 31 shows a further variation of one of the magnetic frame members.

In certain cases it is possible to make use of the frame members 11 only, by using a number of expedients, or elongated frame members having a different shape, for example as shown in FIGS. 30 and 31 of the drawings.

In both cases, the frame member 11 comprises a stem provided with a widened head 11A, designed to be inserted into an appropriate seat or against a shoulder surface of a block 10 during the construction of an assembly or any type of structure; for example the magnetic frame members 11 of FIGS. 30 and 31, could be used in substitution of the frame members 11 and 12 in FIG. 28.

Whereas in FIG. 30 the head 11A consists of a separate part, for example a disk of ferromagnetic material or a magnet directly fastened to the stem 11, or by means of a sheathing 26 of plastic material, in the case of FIG. 31 the head 11A is made in one piece with the stem 11 of the magnetic frame member 11.

Lastly, FIGS. 32, 33, 34 and 35 again show an application of the invention, relating to a magnetic toy with modular elements, representing a generic puppet having human features; the puppet comprises a body 30 and removable appendages consisting, for example, of the head 31, arms 32 and legs 33.

Figure 32:
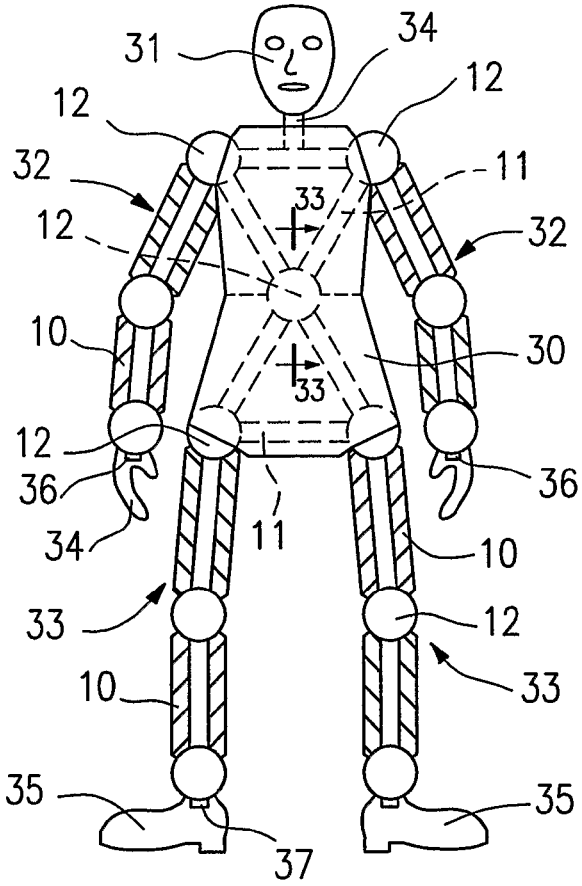
FIG. 32 shows a puppet obtainable by means of several covering blocks, and relevant magnetic frame members.

Likewise to the previous examples, in the case of FIG. 32 the body 30, arms 32 and legs 33, also consist of shaped blocks 10, similar to those previously described, and of special blocks for example for the body 30, magnetically connectable to one another by means of magnetic frame members 11 and 12 housed, also removably, in appropriate seats in the modular blocks of the toy, as described previously.

Figure 33:
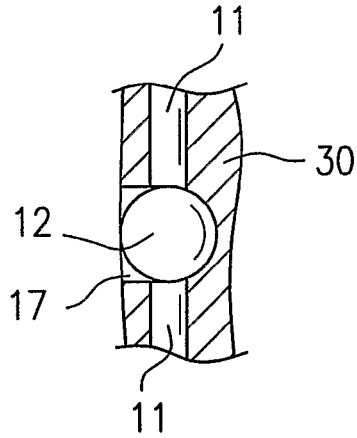
FIG. 33 shows a cutaway view of a detail along the line 33-33 of FIG. 32.

The body 30 of the puppet can be obtained by moulding in one piece, with the seat 17 for insertion of a central ball 12, open at the rear side of the body, as shown in FIG. 33; or the body 30 can be made in two separate parts, as shown by the broken line in correspondence with the central sphere 12 in FIG. 32.

Conversely, the body 30 of the puppet can be composed of a front and a rear half shells, provided for example with pins that snap into appropriate holes, or with other retaining means capable of enabling them to be engaged and disengaged; each half shell can be made with seats for housing the ball members 12 defining the articulations of the shoulders and of the hips, and with seats for the elongated bar members 11, which serve to retain the ball members 12 in their seats, in turn anchoring themselves to the central ball 12.

The head 31 or other appendage can be provided with a magnet 34 or an equivalent magnetic anchoring element 11, which is inserted, also removably, into an appropriate hole in the upper edge of the body 30, to anchor itself magnetically to an elongated bar member 11 disposed transversally between the ball members 12 for articulation of the shoulders.

Figure 34:
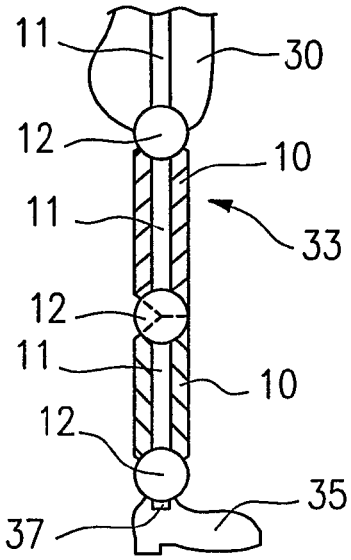
FIG. 34 shows the detail of a lower limb of the puppet of FIG. 32 in an erect condition.
Figure 35:
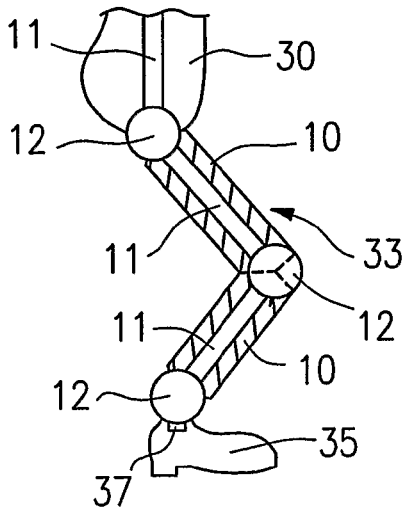
FIG. 35 shows the same limb of the preceding figure, in a bent condition.

In turn, both the arms 32 and the legs 33, as shown by way of example for the latter in FIGS. 34 and 35, can be composed of two blocks 10 of the first type shown in FIG. 4, capable of forming the articulations of the shoulders, the elbows, the wrists, the hips, the knees and the ankles, in which the ball members 12 of the wrist and the ankle in turn partially fit into a seat in a block 34, 35 shaped in such a way as to simulate a hand and a foot, incorporating a magnet 36, 37.

The examples of the previous figures, show, by way of example, several applications of the invention to a generic building and to a puppet, in which use has been made of magnetic frame members 11 and 12 consisting of a ferromagnetic element or a magnet, or comprising at least one magnet and/or at least one ferromagnetic element.

In certain cases or for certain applications for which it is necessary to have greater magnetic anchoring forces, for example anchoring forces in the region of a few kilograms, for which it is difficult if not impossible to manually assemble and disassemble the various components of a magnetic structure according to the invention, in combination with or in substitution of the frame members 11 previously described, in which use is made of simple permanent magnets, it is possible to resort to the use of magnetic frame members or frame members provided on one or both their ends, with an anchoring head which can be magnetically activated and deactivated as described in WO-A-03/003388 of the same applicant, the contents of which are understood to be incorporated in these description.

In short, each anchoring head comprises a stator and a rotor unit having axially aligned permanent magnets, according to which the rotor unit can be rotated between an angular deactivated position in which the magnetic flux is short-circuited inside the anchoring head, and one or more angular activated positions in which all the magnetic flux or part thereof is made to circulate towards a magnetic anchoring element.

According to one variation, the anchoring head can comprise two axially aligned permanent magnet stator units, one of which comprises a set of electric coils to circulate current pulses capable of alternately reversing the polarization of the magnet, and of causing the activation or deactivation of the anchoring head.

From what has been described and shown in the accompanying drawings, it will be clear that what is provided is a system comprising a plurality of modular blocks made of non-magnetic material, appropriately shaped and dimensioned to enable the construction of specific compositions, to imitate any subject, in which the various blocks are maintained in an assembled condition by means of a removable framework composed of a plurality of magnetic frame members, in which the anchoring frame members can be freely inserted into and removed from respective seats made in each of the blocks while maintaining the possibility of reuse of the blocks and magnetic frame members to create other structures and other types of compositions.

Therefore, it is understood that what has been described and shown in the accompanying drawings, has been given purely by way of example, in order to illustrate the general features of the blocks and of the magnetic anchoring frame members according to the invention, as well as some of their possible applications. Other modifications or variations may consequently be made both as regards the shape, dimensions or configuration of the various blocks, and as regards the shape, dimensions and characteristics of the various frame members, their seats and shoulder surfaces without thereby deviating from the scope of the accompanying claims.

The invention claimed is:

1. A constructional modular system comprising:

a first set of magnetically anchorable elongated frame members having a magnetic pole at each end;

a second set of shaped frame members in ferromagnetic material, magnetically anchorable to the elongated frame members of said first set of frame members; and a third set of covering block members for the elongated frame members, in non magnetic material, each block member having side mating and end shoulder surfaces;

wherein each of the covering block members has an elongated through hole extending between a respective pair of end shoulder surfaces, the elongated through hole of each block member having a cross sectional diameter larger than a corresponding cross sectional diameter of the elongated frame members, so that each of the elongated frame members is slidably movable completely through and slidably removable entirely from the elongated through holes of the covering block members, wherein the elongated frame members have a length the same as the distance between the pair of the end shoulder surfaces of the block members, and wherein the elongated and the shaped frame members of said first and second sets of frame members, are magnetically anchorable with each other and arranged, in the assembly, to provide a removable framework that retains the covering block members in an assembled condition of the assembly.

2. The modular system according to claim 1, wherein the end shoulder surfaces are conformed to partially house said second frame members.

3. The modular system according to claim 1, wherein the end should surfaces are conformed to totally house said second frame members.

4. The modular system according to claim 1, wherein the block members are provided with a longitudinal slot on at least one side mating surface.

5. The modular system according to claim 1, wherein the block members comprise at least one through hole transversally arranged to said elongated through hole.

6. The modular system according to claim 1, wherein the block members comprise a half through hole transversally arranged to said elongated through hole at least one end of a block member.

* * * * *